US006082970A

United States Patent [19]

Tsukamoto et al.

[11] Patent Number: 6,082,970

[45] Date of Patent: Jul. 4, 2000

[54] VIBRATION ATTENUATION ARRANGEMENT FOR ROTOR BLADES

[75] Inventors: Minoru Tsukamoto; Ken Mitsubori, both of Yokohama, Japan

[73] Assignee: Ishikawajima-Harima Heavy Industries Co., Ltd., Tokyo, Japan

[21] Appl. No.: 09/079,442

[22] Filed: May 15, 1998

[30] Foreign Application Priority Data

May 26, 1997 [JP] Japan ..... 9-135467

[51] Int. Cl.[7] ..... B63H 1/15

[52] U.S. Cl. ..... 416/196 R; 416/194; 416/190; 416/193 A; 416/220 R; 416/248; 416/500

[58] Field of Search ..... 416/190, 193 A, 416/194, 196 R, 220 R, 248, 500

[56] References Cited

U.S. PATENT DOCUMENTS

| | | | |
|---|---|---|---|
| 2,873,088 | 2/1959 | Neumann | 416/194 |
| 2,962,259 | 11/1960 | Bishop | 416/500 |
| 3,104,093 | 9/1963 | Craig et al. | 416/190 |
| 3,728,044 | 4/1973 | Fujita et al. | 416/190 |
| 3,881,844 | 5/1975 | Hennessey et al. | 416/145 |
| 4,255,086 | 3/1981 | Roberts | 416/218 |
| 4,482,297 | 11/1984 | Mosimann et al. | 416/218 |
| 4,662,824 | 5/1987 | Ortolano | 416/196 R |
| 4,699,569 | 10/1987 | Gloor | 416/191 |
| 5,201,850 | 4/1993 | Lenhardt et al. | 416/190 |
| 5,536,145 | 7/1996 | Vandendriessche | 416/213 R |

FOREIGN PATENT DOCUMENTS

| | | | |
|---|---|---|---|
| 873151 | 6/1971 | Canada | 416/190 |

*Primary Examiner*—Ninh Nguyen
*Attorney, Agent, or Firm*—McCormick, Paulding & Huber LLP

[57] ABSTRACT

An arrangement for attenuating vibrations of blades attached to a peripheral surface of a rotor of an axial turbine. A through hole is formed in each rotor blade in a generally thickness direction of the blade so that the through holes in combination define a single annular passage near a rotor surface when all of the rotor blades are attached to the rotor. A wire is provided to extend through the aligned through holes. Thus, the wire frictionally contacts the through holes when the blades are caused to vibrate due to a gas pressure and a centrifugal force generated upon operation of the axial turbine. Friction contact between the wire and the through holes attenuates vibrations of the blades.

22 Claims, 4 Drawing Sheets

FIG. 1
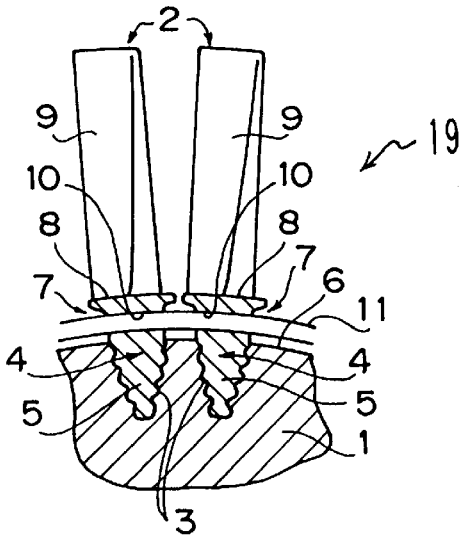
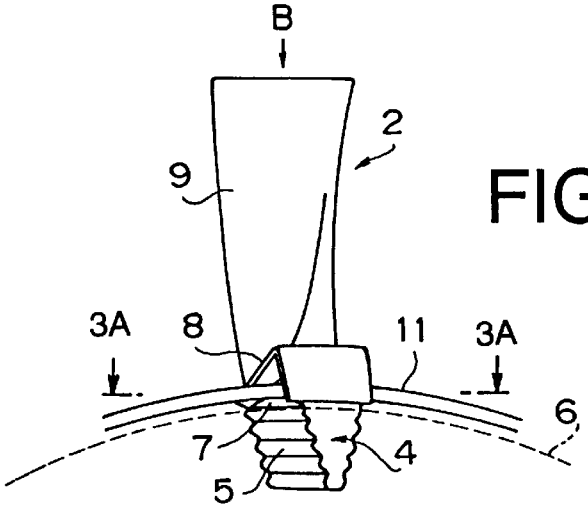
FIG. 2
FIG. 3A
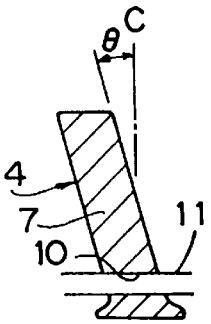
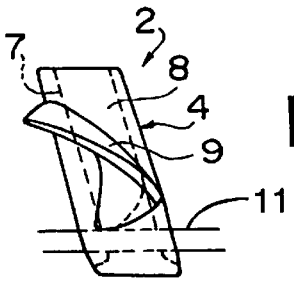
FIG. 3B

FIG. 4A
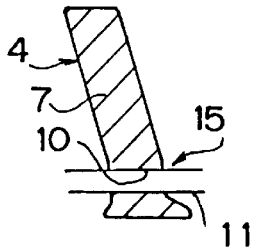
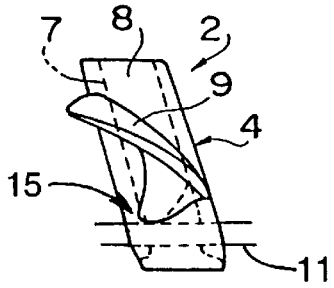
FIG. 4B
FIG. 5
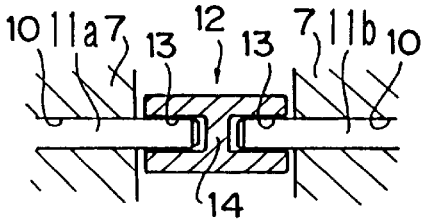
FIG. 6
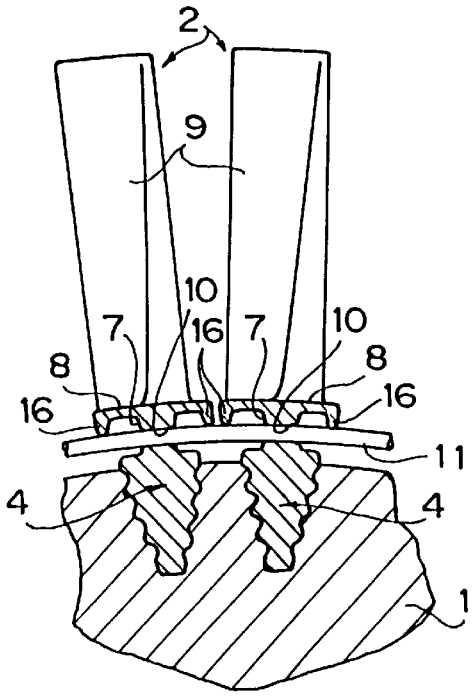

PRIOR ART

VIBRATION ATTENUATION ARRANGEMENT FOR ROTOR BLADES

BACKGROUND OF THE INVENTION

1. Technical Field

The present invention relates to an arrangement for attenuating vibrations of moving blades of axial turbines, compressors or the like.

2. Background Art

Generally, an axial turbine or compressor has a so-called dove tail structure. Referring to FIG. 9 of the accompanying drawings, illustrated is a major portion of such a type of axial turbine or compressor "e". As depicted, this axial turbine "e" includes a rotor "a", a plurality of grooves "b" formed in an outer surface of the rotor "a", and a plurality of moving blades (or rotor blades) "c" loosely fitted in the grooves "b" respectively. During operation of the turbine or compressor "e", the moving blades "c" vibrate or swing about their pivots (i.e., roots "d") due to gas pressure and/or centrifugal force. In order to suppress the vibrations or swinging movements of the blades "c", conventionally a through opening "f" is formed in each blade "c" near a free end of the blade and a wire "g" is provided to pass through the aligned openings "f". Frictions caused between the wire "g" and the openings "f" due to the vibrations of the blades "c" reduce the vibrations of the blades "c". Ends of the wire "g" are crushed to have enlarged ends (not shown) to prevent the wire "g" from falling off from the through openings "f". The enlarged ends are larger than the openings "f" and made by plastic deformation.

However, the above described conventional arrangement has the following drawbacks:

(1) The wire "g" exits in a gas passage around the rotor "a" so that the wire "g" reduces an area of the gas passage and also raises a resistance of the gas passage. This results in deterioration of aerodynamic performance of the turbine (or compressor) "e";

(2) A centrifugal force acting on the wire "g" is transmitted to a thin portion of each of the blades "c" so that the blades are likely damaged. In particular, since the opening "f" extends diagonally relative to the thick direction of the associated blade "c", strength of each blade is considerably affected by the opening "f"; and (3) When removing the blades "c" from the rotor "a" to replace them with new ones, for example, the wire "g" should be cut. Thus, a new wire is always required when reassembling the turbine "e".

SUMMARY OF THE INVENTION

An object of the present invention is to propose a vibration attenuation arrangement for rotor blades of an axial turbine or compressor, which can eliminate the above mentioned problems of the conventional arrangement.

According to one aspect of the present invention, there is provided improvement to an arrangement for reducing vibrations of rotor blades of an axial turbine, compressor or the like, characterized in that the rotor blades have through openings at their exposed root portions near an outer surface of a rotor respectively such that the through holes are aligned to define a single circular passage along (but spaced from) the rotor surface and a wire is provided to pass through this circular passage such that the wire frictionally contacts the aligned openings when the rotor blades vibrate.

The wire extends circularly near a peripheral surface of the rotor so that it can substantially be said that the wire does not exist in a gas passage of the turbine or compressor. Accordingly, a channel resistance produced by the wire is significantly reduced and an aerodynamic performance is not deteriorated by the wire. In addition, the root of each of the blades has a certain thickness (thicker than a blade portion of the blade above the root portion) so that possibility of breakage due to the wire is substantially eliminated. After circularly passing the wire through the aligned holes, ends of the wire are joined with each other by an intermediate joint member positioned between a particular two adjacent blades. The joint member may have two recesses in its opposite end faces to receive the ends of the wire. The joint member allows an operator to pull the wire out of the through holes without damaging the wire and the blades. The same wire can be used repeatedly. The joint member also serves as a member for preventing the wire from falling off from the through holes.

The wire may be defined by a plurality of serially arranged wire segments. These wire segments are joined by a plurality of intermediate members.

Each of the blades may have an extension to contact the wire outside the through hole. Both the through holes and the extensions are in friction contact with the wire when the rotor blades vibrate. Thus, vibrations are promptly attenuated.

A plurality of through holes may be formed in each blade to define a plurality of circular passages around the rotor surface and a plurality of wires may be provided to extend through these passages respectively.

BRIEF DESCRIPTION OF THE ACCOMPANYING DRAWINGS

FIG. 1 illustrates an arrangement for attenuating vibrations of rotor blades according to the present invention with roots of the rotor blades and a rotor being shown in cross section;

FIG. 2 is a view similar to FIG. 1 but viewed from a slightly different direction, illustrating one of the rotor blades of FIG. 1 with the blade root not being shown in cross section;

FIG. 3A illustrates a cross sectional view as taken along the line A—A of FIG. 2;

FIG. 3B illustrates a view when seen from the direction indicated by the arrow B of FIG. 2;

FIGS. 4A and 4B illustrate in combination a modification of the first embodiment shown in FIG. 1, and FIG. 4A illustrates a diagram similar to FIG. 3A and FIG. 4B is similar to FIG. 4B;

FIG. 5 illustrates a cross section of an intermediate joint member for joining two wire lengths and preventing the wire lengths from falling off from the through holes when a single wire surrounding a rotor is made from the two lengths;

FIG. 6 illustrates another embodiment according to the present invention;

DETAILED DESCRIPTION OF THE PREFERRED EMBODIMENTS

Figure 7:
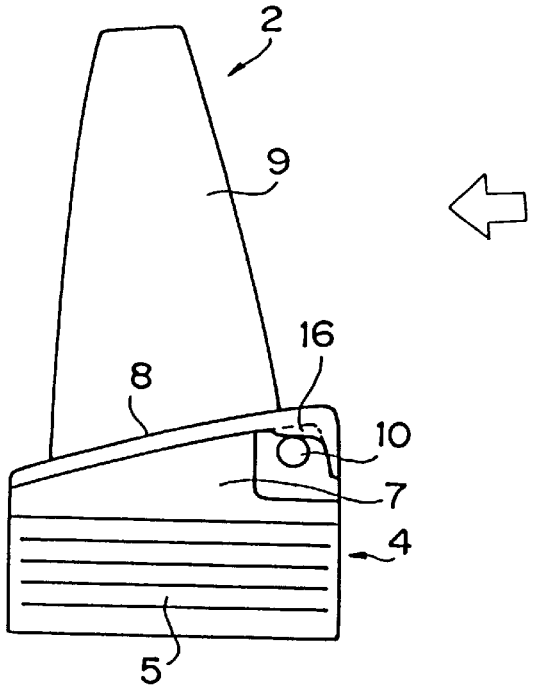
FIG. 7 illustrates a lateral view of one of moving blades shown in FIG. 6 when removed from the rotor.
Figure 9:
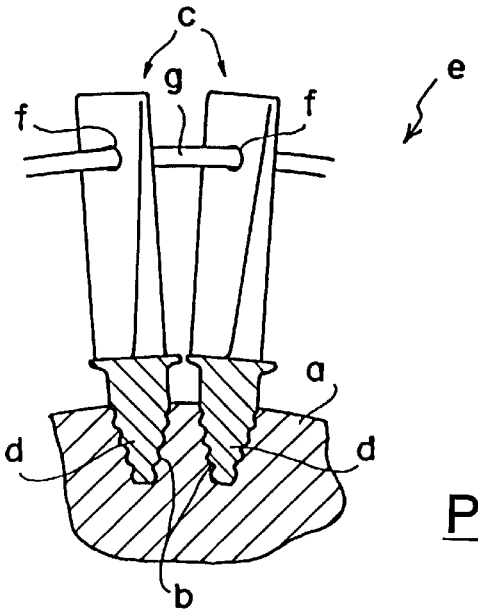
FIG. 9 illustrates a conventional arrangement.

Now, preferred embodiments of the present invention will be described with reference to the accompanying drawings.

Referring to FIG. 1, a rotor 1 of an axial turbine (or compressor) 19 has a plurality of moving blades 2 buried in a rotor surface 6. Specifically, the rotor 1 has a plurality of recesses 3 in its surface 6, and roots 4 of the moving blades 2 are loosely fitted in the associated recesses 3. Each of the roots 4 has a buried portion 5 having an inverted stepwise taper or Christmas tree shape. Each root 4 also has an exposed portion 7 which projects radially outward from the surface 6 of the rotor 1. The recesses 3 are shaped to loosely conform with the lower portions 5 of the roots 4. Each of the upper exposed portions 7 has a seating portion 8 having an enlarged diameter. A blade portion 9 stands radiantly outward from each seating portion 8.

As understood from FIGS. 2, 3A and 3B, each of the recesses 3 extends diagonally relative to an axial direction C of the rotor 1 with a predetermined angle (stagger angle θ) as viewed from the top. The mating root portion 4 is also inclined relative to the axial direction C of the rotor 1. FIG. 2 is an illustration when viewed from the axial direction C of the rotor 1. In FIG. 2, the rotor axis extends perpendicularly to the drawing sheet. It should be noted that FIG. 1 is a drawing when viewed from a direction inclined by θ relative to the axial direction of the rotor C. In FIGS. 1 and 2, a gas flows generally perpendicularly toward the drawing sheet from a viewer side.

As illustrated in FIGS. 1, 2 and 3A, the exposed portion 7 of each blade root 4 has a through hole 10. The through holes 10 are aligned in a circumferential direction of the rotor 1 along the rotor surface 6 to define a circular passage around the rotor 1 when all the rotor blades 2 are fitted in the associated grooves 3. A wire 11 circularly extends through the annually arranged openings 10 (or circular passage) so that the wire 11 surrounds the rotor 1 circumferentially. The wire 11 is spaced from the rotor surface 6. As best understood from FIGS. 3A and 3B, which illustrate the wire 11 and openings 10 in a plan view, the openings 10 are formed on the entrance side of the turbine or compressor 19 (In drawing sheet of FIGS. 3A/3B, the gas flows from the bottom toward the top). The wire 11 can slide in the aligned through openings 10 in the circumferential direction of the rotor 1. When the wire 11 slides in the openings 10, a friction force is generated between the wire 11 and the openings 10. In this particular embodiment, two separate wire lengths 11*a* and 11*b* (FIG. 5) are joined to the single wire 11. Each of the lengths 11*a* and 11*b* surrounds a half of the rotor 1.

Referring now to FIG. 5, one end of one wire length 11*a* is opposed to one end of the other wire length 11*b*, and these opposed ends are joined with each other by a joint member 12. It should be noted here that FIG. 5 illustrates only one joint member 12 but there is another joint member at a 180-degree spaced position. The joint member 12 has a length substantially equal to a gap between the two adjacent exposed portions 7 of the neighboring blades 2. The joint member 12 is shaped like a sleeve, is made from a metal and has concave portions 13 in both ends thereof to receive the wire segments 11*a* and 11*b* respectively. An operator can insert the wire segment into a mating concave portion 13 by hand and pull the wire segment out of the mating concave portion by hand. Each of the concaves 13 is a bore having a circular cross section which conforms to a cross section of the wire segment 11*a*/11*b*. These bores 13 are separated by a center wall 14. As illustrated, there is a certain clearance between an end face of the wire segment 11*a*/11*b* and the center wall 14. When one end of the wire segment 11*a* tends to slide off from the mating bore 13, the other end of the same wire segment 11*a* abuts the center wall of the opposite joint. member. If the wire segment 11*a* further tends to slide off from the mating bore 13, then the opposite joint member collides with an exposed portion of a blade. Accordingly, the movement of the wire segment 11*a* is terminated. Therefore, the wire segment 11*a* does not fall off from the associated bore 13. In other words, the intermediate members 12 prevent falling off of the wire segments 11*a* and 11*b* from the openings 10. In this manner, the position of the wire 11 relative to the rotor 1 is fixed, and the wire 11 rotates with the rotor 1.

Referring back to FIG. 1, there is a subtle (generally invisible and cannot be illustrated in the drawing) gap between each groove 3 and the buried root portion 5 of the associated blade 2 so that each blade 2 is caused to vibrate or swing by a centrifugal force and a gas pressure when the turbine 19 is operated and the rotor 1 is accordingly rotated. The buried portion 5 of the blade 2 becomes a pivot of vibration. However, the through hole 10 of each blade 2 is in friction contact with the wire 11 during the vibration or swinging movement of the blade 2 so that the vibration of the blade 2 is attenuated.

In this invention, the wire 11 circularly extends close to the outer surface 6 of the rotor 1 through the root portions 4 (more accurately, the exposed portions 7 of the root portions 4), unlike the conventional arrangement. Accordingly, the gas passage area around the rotor 1 is not substantially reduced by the wire 11 and a gas passage resistance is not substantially raised by the wire 11. Consequently, an aerodynamic performance of the turbine (or compressor) 19 employing this rotor arrangement is greatly improved. In addition, since the exposed portion 7 of each root portion 4 of the blade 2 is thick and rigid as compared with the blade portion 9 of the blade 2, it is possible to eliminate a possibility of breakage of the moving blade 2 due to a centrifugal force applied from the wire 11. In addition, the longitudinal length of the wire 11 in the circumferential direction of the rotor 1 is shorter than the conventional one, the weight of the wire 11 is correspondingly reduced and the position of the wire 11 is closer to the center of the rotor 1 so that a centrifugal force generated by the wire 11 is significantly reduced. Thus, possibility of breakage of the blades 2 is substantially eliminated.

The joint members 12 of the present invention are advantageous in the following point. The wire segments 11*a* and 11*b* are simply received in the recesses 13 of the intermediate members 12 and it is possible to join and remove the wire segments 11*a* and 11*b* to and from the joint members 12 by an operator's hand. Thus, installation and removal of the wire 11 are easy operations. When disassembling the turbine 19, all the moving blades 2 are removed from the rotor 1 simultaneously, and then the wire segments 11*a* and 11*b* are removed from the intermediate members 12. When reassembling the turbine, the same wire segments 11*a* and 11*b* can be utilized. The intermediate members 12 are also reusable. The intermediate joint members 12 are simple but effective members for preventing failing off of the wire 11 from the through holes 10.

As understood from FIGS. 3A and 3B, the wire 11 extends perpendicularly relative to the direction C of the rotor shaft and the through holes 10 are also arranged in the same direction. However, the root portion 4 of each rotor blade 2 extends diagonally relative to the rotor shaft direction C by the stagger angle θ so that the through holes 10 extend diagonally relative to the thickness direction of the exposed portions 7. This might be undesirable in terms of strength. FIGS. 4A and 4B illustrate a modification to the shape of the exposed portion 7. That portion 15 of the exposed portion 7 which the wire 11 extends through (i.e., the material around the through hole 10) is slightly cut away (or bent to left in the illustration) to align with the axial direction C of the rotor 1 so that the wire 11 extends through the portion 15 perpendicularly. In this modification, the through hole 10 exactly extends in the thickness direction of the bent portion 15 so that strength of the root portion 4 of the blade 2 is improved.

FIGS. 6 and 7 in combination illustrate another embodiment of the present invention. Friction between the through holes 10 and the wire 11 is increased in this embodiment. As illustrated in FIG. 6, the flange-like portion 8 at the bottom of the blade portion 9 or at the top of the root portion 4 of the blade 2 has extended pedestal-like materials 16 to contact the wire 11. These materials 16 extend downward toward the rotor surface 6 but spaced from the rotor surface. The extended materials 16 are in slide (or friction) contact with the wire 11 in addition to the through hole 10 when the blade 2 vibrates. Therefore, a greater friction force acts on the wire 11. This is advantageous in terms of vibration attenuation. In practice, the right and left ends of the flange-like portion 8 (or the circumferentially extending ends of the portion 8) are bent downward (or in a radially inward direction of the rotor 1) to define the pedestals 16. As illustrated in FIG. 7, the extended materials 16 are only formed at an upstream side ("upstream" in terms of a gas flow direction of the turbine 19) of the flange-like portion 8 in this particular embodiment. The gas flow direction is indicated by the unshaded arrow.

Figure 8:
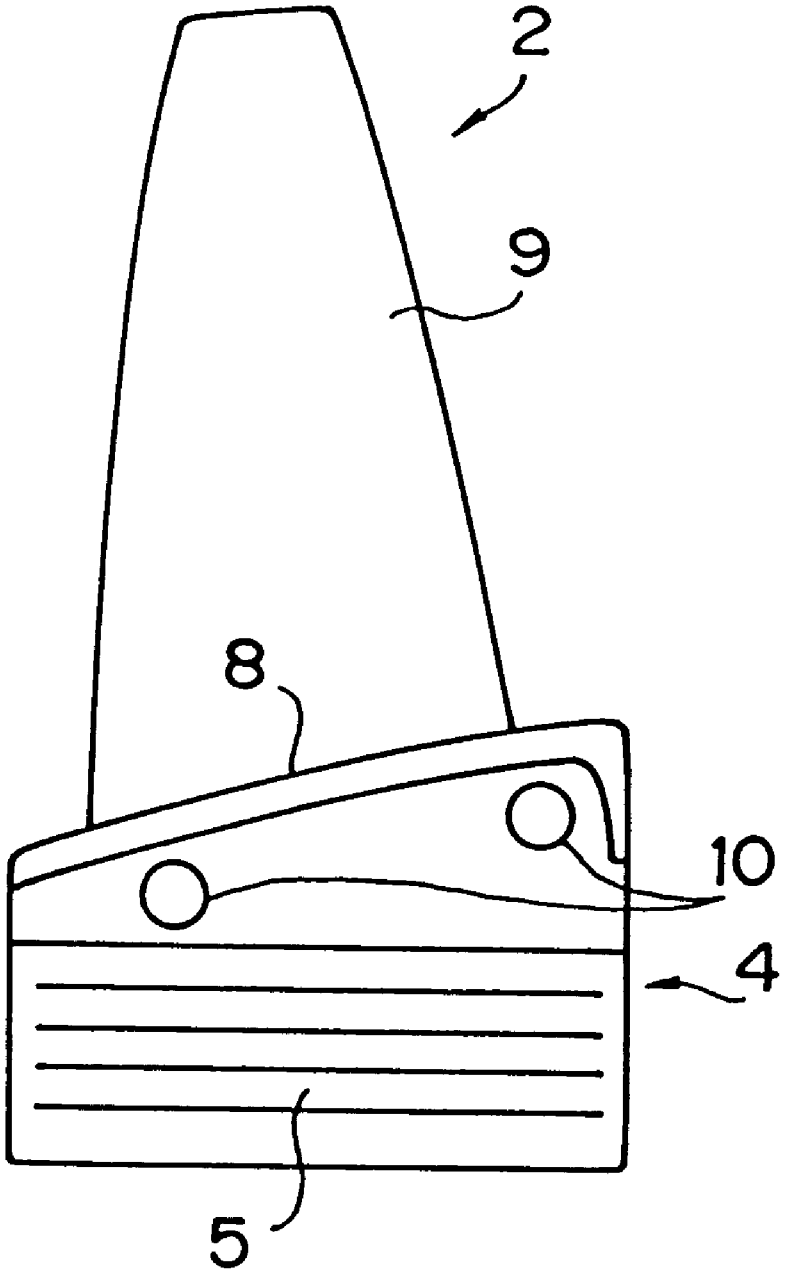
FIG. 8 illustrates still another embodiment of the present invention.

The present invention is not limited to the above described embodiments and modifications. For example, the through hole 10 may extend through a different area of the exposed portion 7 of the blade 2. For instance, the position of the through hole 10 may be shifted to the downstream side in terms of the gas flow direction of the turbine. Further, the wire 11 may be divided into more than two segments and the number of the joint members 12 may be increased correspondingly. On the contrary, the wire 11 may not be divided into a plurality of segments but may be comprised of a single segment. In this case, only one joint member 12 is needed. In addition, as illustrated in FIG. 8, a plurality of through holes 10 may be formed in the root portion 4 of each blade 2 and a plurality of wires 11 may extend correspondingly. The joint member 12 may be made from a material other than metal as long as it can bear a load acting thereon. The teaching of the present invention is applicable to not only the axial turbine or compressor but also various types of rotating apparatuses having moving blades.

What is claimed is:

1. An arrangement for attenuating vibrations of blades buried in a rotor, the arrangement comprising:

a plurality of blades to be buried in a rotor, each of the blades having a through hole such that the through holes cooperate to define a single substantially annular passage to extend near a rotor surface when all rotor blades are attached to the rotor, and each of the blades having at least one extension; and a wire extending through the through holes such that the wire frictionally contacts the through holes when the blades vibrate to attenuate blade vibration, the at least one extension of each of the blades to contact the associated wire outside the through holes to further attenuate blade vibration.

2. The arrangement of claim 1, wherein each through hole extends in a direction perpendicular to a rotor axial direction.

3. The arrangement of claim 1 further including an intermediate member located between neighboring blades for preventing the wire from falling off from the through holes, and wherein the wire is comprised of a single wire segment, and ends of the single wire segment are joined with each other by a single intermediate member.

4. The arrangement of claim 3, wherein each intermediate member has recesses in its end faces respectively to receive the ends of the wire segment in the recesses of the intermediate member respectively.

5. The arrangement of claim 3, wherein a length of each intermediate member in a longitudinal direction of the wire is substantially equal to a gap between two adjacent blades.

6. The arrangement of claim 1, wherein the through hole is formed in a relatively thick portion of each blade relative to a free end of the blade.

7. The arrangement of claim 1, wherein a thickness direction of that portion of the blade which the through hole extends through coincides with a longitudinal direction of the wire.

8. The arrangement of claim 1, wherein each through hole is formed in a root portion of the blade that is exposed from a rotor surface.

9. The arrangement of claim 1 further including a plurality of intermediate members each located between neighboring blades for preventing the wire from falling off from the through holes, and wherein the wire is comprised of a plurality of wire segments to define a single wire, and opposed ends of each two adjacent wire segments are joined with each other by one of the intermediate members.

10. The arrangement of claim 9, wherein each intermediate member has recesses in its end faces respectively to receive the ends of the wire segments in the recesses of the intermediate member respectively.

11. The arrangement of claim 9, wherein a length of each intermediate member in a longitudinal direction of the wires is substantially equal to a gap between two adjacent blades.

12. An arrangement for attenuating vibrations of blades buried in a rotor, the arrangement comprising:

a plurality of blades to be buried in a rotor, each of the blades having a plurality of parallel through holes such that the through holes cooperate to define a plurality of substantially annular passage each to extend near a rotor surface when all rotor blades are attached to the rotor, and each of the blades having at least one extension; and a plurality of wires extending through the plurality of through holes respectively such that each of the wires frictionally contacts the associated through holes when the blades vibrate to attenuate blade vibration, the at least one extension of each of the blades to contact the associated wire outside the through holes to further attenuate blade vibration.

13. The arrangement of claim 12, wherein each through hole extends in a direction perpendicular to a rotor axial direction.

14. The arrangement of claim 2 further including plurality of intermediate members each located between neighboring blades for preventing the wires from falling off from the through holes, and wherein each wire is comprised of a single wire segment, and ends of each single wire segment are joined with each other by a single intermediate member.

15. The arrangement of claim 14, wherein each intermediate member has recesses in its end faces respectively to receive the ends of the wire segment in the recesses of the intermediate member respectively.

16. The arrangement of claim 14, wherein a length of each intermediate member in a longitudinal direction of the wire is substantially equal to a gap between two adjacent blades.

17. The arrangement of claim 2, wherein the through holes are formed in a relatively thick portion of each blade relative to a free end of the blade.

18. The arrangement of claim 2, wherein a thickness direction of that portion of the blade which the through holes extend through coincides with a longitudinal direction of the wire.

19. The arrangement of claim 12, wherein each through hole is formed in a root portion of the blade that is exposed from a rotor surface.

20. The arrangement of claim 12 further including a plurality of intermediate members each located between neighboring blades for preventing the wires from falling off from the through holes, and wherein each of the wires is comprised of a plurality of wire segments to define a single wire, and opposed ends of each two adjacent wire segments are joined with each other by one of the intermediate members.

21. The arrangement of claim 20, wherein each intermediate member has recesses in its end faces respectively to receive the ends of the wire segments in the recesses of the intermediate member respectively.

22. The arrangement of claim 20, wherein a length of each intermediate member in a longitudinal direction of the wires is substantially equal to a gap between two adjacent blades.

* * * * *

UNITED STATES PATENT AND TRADEMARK OFFICE

CERTIFICATE OF CORRECTION

PATENT NO. : 6,082,970
DATED : July 4, 2000
INVENTOR(S) : Tsukamoto et al.

It is certified that error appears in the above-identified patent and that said Letters Patent is hereby corrected as shown below:

Column 6, claim 14,
Line 1, delete "claim 2" and insert -- claim 12 --.

Column 7, claim 17,
Line 1, delete "claim 2" and insert -- claim 12 --.

Column 7, claim 18,
Line 1, delete "claim 2" and insert -- claim 12 --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*